United States Patent [19]

van Eijsden et al.

[11] Patent Number: 4,872,302

[45] Date of Patent: Oct. 10, 1989

[54] METHOD OF, AND APPARATUS FOR, WRAPPING ARTICLES IN A PLASTIC FILM

[75] Inventors: Cornelis van Eijsden, Apeldoorn; Jan C. Mersman, Rhenen, both of Netherlands

[73] Assignee: Borden BV, Apeldoorn, Netherlands

[21] Appl. No.: 227,340

[22] Filed: Aug. 2, 1988

[51] Int. Cl.[4] ..... B65B 11/12; B65B 9/06; B65B 53/00

[52] U.S. Cl. ..... 53/441; 53/450; 53/550; 53/556; 53/389

[58] Field of Search ..... 53/450, 451, 441, 550, 53/551, 552, 556, 389

[56] References Cited

U.S. PATENT DOCUMENTS

| | | | |
|---|---|---|---|
| 3,589,091 | 6/1971 | Cloud . | |
| 3,795,080 | 3/1974 | Smolderen et al. | 53/450 X |
| 3,919,739 | 11/1975 | Kawai | 53/450 X |
| 4,430,844 | 2/1984 | James | 53/450 |
| 4,483,125 | 11/1984 | Suga | 53/450 |
| 4,546,595 | 10/1985 | Yasumune et al. | 53/550 X |
| 4,625,495 | 12/1986 | Holovach | 53/450 |
| 4,642,969 | 2/1987 | Johnson | 53/550 X |
| 4,658,569 | 4/1987 | Hanagata | 53/550 |
| 4,691,499 | 9/1987 | Umeda et al. | 53/451 |
| 4,729,210 | 3/1988 | Galliano | 53/441 |
| 4,738,079 | 4/1988 | Lancaster et al. | 53/450 |

FOREIGN PATENT DOCUMENTS

| | | |
|---|---|---|
| 2035250 | 6/1980 | United Kingdom . |
| 2097356 | 4/1982 | United Kingdom . |

*Primary Examiner*—Horace M. Culver

*Attorney, Agent, or Firm*—Robbins & Laramie

[57] ABSTRACT

Articles are stretch wrapped in a plastic film by forming a tube around them from a flat plastic film, sealing the longitudinal edges of the film and then longitudinally stretching the tube to cause it to constrict on the articles being wrapped. The tube is initially of a sufficient diameter to avoid contact with the articles. Both the articles and the tube are conveyed downstream. The tube is fed downstream by a positive transport means which isolates the tube forming operation from any downstream tension. A downstream mechanism pulls on the tube faster than the positive transport means conveys it causing the tube to stretch and constrict on the articles to be wrapped. The tube is closed behind each set of articles and the downstream portion is severed from the upstream portion forming a tube terminus behind one set of articles and in front of the next set. In a preferred version the positive transport means is a sleeve over which the tube passes and through which the articles pass combined with rollers which press the tube against the sleeve and control its forward progress over the sleeve.

21 Claims, 1 Drawing Sheet

METHOD OF, AND APPARATUS FOR, WRAPPING ARTICLES IN A PLASTIC FILM

FIELD OF THE INVENTION

This invention relates to a method of wrapping articles in a plastics film which is applied in tubular form around a unit of articles and thereby subjected to a stretching and springback treatment to cause said film to contract tautly on to the unit being wrapped. The invention also relates to apparatus for carrying out such a method.

BACKGROUND OF THE INVENTION

For wrapping articles, for example, tins, boxes, bottles and the like, placed on or in a carrier, such as a tray, use is often made of shrink wrapping film. For this purpose the unit to be wrapped is loosely surrounded by an envelope of shrink wrapping film, whereafter this combination is passed through a shrinking tunnel, in which such a high temperature prevails that the film shrinks and will thus snugly enclose the unit being wrapped. This known wrapping method has a number of disadvantages. Thus the presence of a shrinking tunnel not only means occupying a relatively large space, but also the consumption of considerable amounts of heating energy, as most shrink wrapping films only begin to shrink at a temperature as high as 180°-200° C. This latter also means that this method does not permit wrapping heat-sensitive products, while further the necessary fire fighting provisions should be present. In addition, this wrapping method does not produce a product of aesthetic appearance, as the shrink film may be of non-uniform thickness and may exhibit wrinkles, folds or holes, or be fused to the carrier.

A method of the kind specified in the opening paragraph is known from British patent application 2035250. In that prior method, a tube formed of film material is shifted over four jaws which are movable relatively to each other. By moving the jaws apart, the tube if stretched, whereafter the article to be wrapped is placed in the interior of the tube. By subsequently moving the jaws towards each other, the contracting film comes into contact with the article, which after the withdrawal of the jaws is enclosed by the taut film. One disadvantage of this prior method is that it cannot be carried out continuously, as a tube must be formed, stretched and relaxed for each individual article to be wrapped, and an article being wrapped must be discharged in the same direction as it is supplied. Furthermore, the withdrawal of the jaws along the taut film, which must remain in position around the article, may cause problems, in particular cause the film surrounding the article to wrinkle.

Furthermore, U.S. Pat. No. 3,589,091 discloses a method for wrapping articles in film, in which the film is first stretched, then loosely wrapped around the articles in tubular form, and thereafter sealed, both longitudinally of the tube and transversely thereto, to produce a wrapper that encloses the articles on all sides. This method requires the use of a special type of film namely, having a memory characteristic such that when stretched, the material does not immediately contract elastically, but only slowly returns to a less stretched condition, which characteristic is used to enable the articles to be loosely wrapped and sealed, after which the film shrinks tautly on to the articles. Thus as far as processing is concerned this stretch wrapping film is comparable to a shrink wrapping film.

It is an object of the present invention to provide a method which does not have the disadvantages described above, and gives a product of aesthetic appearance.

SUMMARY OF THE INVENTION

This is achieved in accordance with the present invention, by folding and connecting a stretch wrapping film supplied from at least one supply roll into the form of a tube with a cross-section sufficiently large to introduce a unit to be wrapped into such tube and transport it therein without the unit to be wrapped making contact with the tube wall, stretching the tube thus made in its longtudinal direction to such an extent as to cause said tube to constrict and contract tautly on to the unit being wrapped, and closing, possibly sealing, and separating the stretched and constricted tube in front of and behind the unit being wrapped for enveloping the unit being wrapped with tautly stretched film.

DETAILED DESCRIPTION OF THE INVENTION

Figure 1:
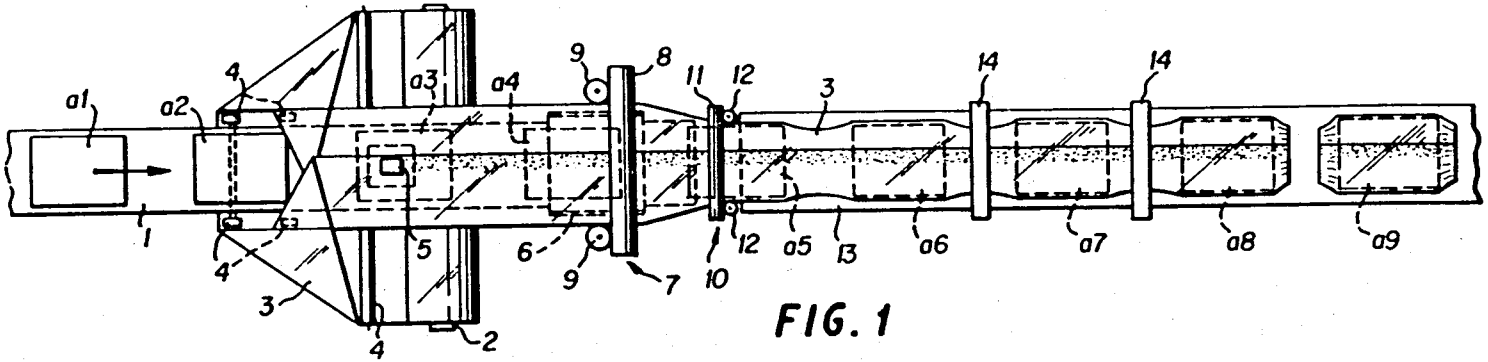
FIG. 1 diagrammatically shows a wrapping apparatus according to the present invention in top plan view.
Figure 2:
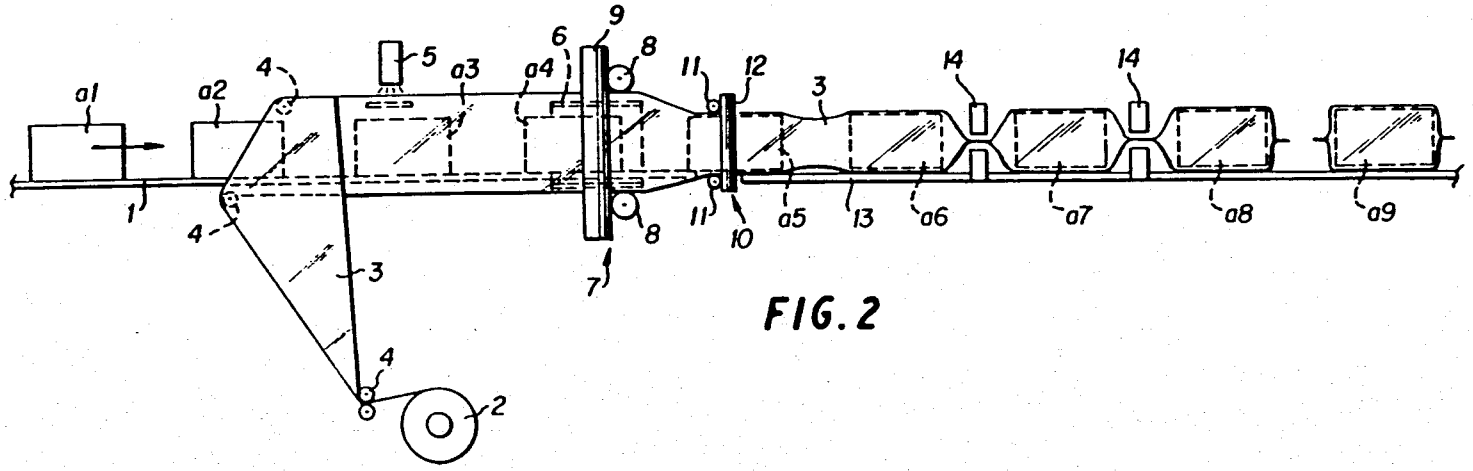
FIG. 2 shows the wrapping apparatus illustrated in FIG. 1 in side elevational view.

Owing to the use of a stretch wrapping film, in the first place a shrinking tunnel, with the disadvantages inherent in it and in the thermal treatment, is unnecessary. The contraction of the film into contact with the article is realized by stretching the tube formed with the film, as a result of which the tube not only becomes longer, but is also constricted. This latter property is used to advantage to provide a continuous process for introducing and wrapping units to be packaged into the tube without any problems, using a normal or special stretch wrapping film and without using stretching members which are to be displaced and withdrawn. As a matter of fact, as constriction takes place later, the unstretched tube may be given such a diameter that it surrounds the units to be packaged with clearance, so that the transport means may extend into the tube without, for example, causing problems with regard to moving the tube in the direction of transport. As, in addition, the tube needs not surround the units to be wrapped under tension, it also becomes possible to connect the folded film to form the tube, for example by sealing, which cannot be effected under tension. The result of the method is a product having an attractive appearance, for one thing by reason of the uniformly stretched film, which as a result is uniformly transparent throughout. It is observed that, although by unit weight, stretch wrapping film is more expensive than shrink wrapping film, the ultimate cost of material per packaged unit will be lower, as a considerably lighter weight in film is used for each pack.

In order to prevent the stretching treatment from having an adverse effect on the connecting of the film into a tubular form, it is preferable, and in accordance with a further embodiment of the invention, that the region in which the film is formed and connected into a tube is kept substantially free from tension by causing that region to be kept separate from the region in which the tube is stretched in the longitudinal direction, by positive transport means. In this arrangement, the positive-transport means perform a double function if, in accordance with a still further embodiment of the present invention, the tube is longitudinally stretched by exerting a tensile force on the tube via means for closing the tube and/or means engaging with a unit to be wrapped that is already tautly enveloped by the tube, and thereby causing said positive-transport means to pass less length of tube than the means exerting a tensile force would displace, if the tube were free to move. In that embodiment, the means for closing the tube may also have a double function, namely, stretching the tube and completing the total enclosure of the unit being wrapped.

The stretching of the tube will be simplest to realize if the film does not need to slide over the product being wrapped. For that reason it is preferable and in accordance with yet a further embodiment of the present invention, that the tube stretching region is concentrated substantially in a portion of a path of travel intermediate the tensile force exerting means and the positive-transport means, said portion being bounded at one end by said positive-transport means and at the other end by means defining a passageway attuned to the cross-section of a unit being wrapped that is tautly enveloped by film. A first step initiating the envelopment of the end faces of a unit to be wrapped, as viewed in the direction of transport, is realized if, in accordance with a further embodiment of the present invention, a unit to be wrapped is supplied to the means attuned to its cross-section in spaced relationship to a preceding unit being wrapped. In that case, an extra constriction will be formed between two units, starting from the means attuned to the cross-section of the unit. The spacing to be maintained between two units will depend on the height of the units and the desired degree of stretching.

For optimum results as regard as cost price and outward appearance a preferred film material for use in carrying the method according to the invention into effect according to the invention also permits providing the film with a tear strip extending in its longitudinal direction or its direction of transport, as in fact no heat treatment needs to be performed, which would cleave a tear strip placed in the film.

The present invention also relates to apparatus for carrying out a method as described above. For this purpose the present invention provides an apparatus comprising at least one holder for a roll of film webbing, wrapping means for applying a film wrapper, in tubular form, around a unit of articles being wrapped, for causing said film, by a stretching and springback treatment, to contract tautly on to the unit being wrapped, and for separating the tubular film wrapper, means for supplying a unit to be wrapped, and means for discharging a wrapped unit, as disclosed in British patent application 2035250, characterized in that the wrapping means for applying a film wrapper around a unit of articles to be wrapped comprise a folding and guiding unit which brings the film into tubular form, and elements connecting the film to produce a closed tubular form, the wrapping means for causing the film to contract tautly on to the unit being wrapped comprise a sleeve member, positive-transport means placed alongside and cooperating with, the outer circumference of said sleeve member, and drawing means positioned downstream of said positive-transport means and movable in the direction of film transport at a velocity higher than the velocity of the positive-transport means, the wrapping means for separating a wrapped unit comprise a clamping mechanism, optionally a sealing mechanism and a separating mechanism, and the means for transporting a unit being interrupted downstream of the downstream end of said sleeve member, with the upstream part of the transport means extending through said sleeve member down to at least the downstream end thereof.

Preferably the drawing means consist of the clamping mechanism and/or conveyor belts disposed along two opposite sides of the path of transport downstream of said positive-transport means. Concentrating the stretch to substantially a region in which there is no contact yet between film and units being wrapped can be promoted if diaphragm means are disposed intermediate said positive-transport means, on the one hand, and said drawing means on the other, said diaphragm means defining a free passageway smaller than that of the sleeve member. Such diaphragm means can be implemented in a relatively simple manner if, in accordance with a further embodiment of the invention, they comprise a set of four rollers, positioned two by two in parallel relationship and together surrounding a rectangular passageway. A further advantage can be achieved if the positive transport means comprise at least one set of four rollers positioned two by two in parallel relationship and together forming a rectangular passageway attuned to the outer circumference of the sleeve member which is also rectangular in cross-section, and in which preferably the rollers are made of a resilient material, such as rubber, and the sleeve member is made of a rigid material, such as steel. Making the rollers of resilient material makes for the passage of a tube seam without any problems, while further the rollers engaged with film in a contacting area rather than a contacting line, which is to the benefit of their positive-transport function, and also promotes the connecting region being kept free from tension.

One embodiment of a wrapping method and apparatus according to the present invention will now be described, by way of example, with reference to the accompanying drawings.

Referring to the drawings, there is shown a conveyor 1 for supplying units a1–a4 to be wrapped. Conveyor 1 may be of any desired form, such as, for example, a driven belt of roller conveyor or a combination of freely rotating rollers or balls and a dragger chain or belt.

Disposed under conveyor 1 is a supply holder 2 with a roll of film webbing 3 arranged for rotation. By means of a folding and guiding unit provided with rollers 4 the film 3 is brought into a tubular configuration enveloping conveyor 1 and the products a1–a4 to be wrapped, the free passageway of the tube being such that conveyor 1 and units a1–a4 to be wrapped are surrounded with clearance and the free longitudinal edges of the tubular film 3 overlap. At the overlap a connecting unit 5 is provided over conveyor 1, which indissolubly connects the overlapping parts of film 3. The connecting unit 5 could just as well have been placed adjacent to the conveyor 1. It is just to be necessary that the folding and guiding unit provide the overlap in the film in the immediate proximity to the unit 5.

The tubular form is maintained, on the one hand, by the folding and guiding unit and on the other hand by a sleeve member 6 of rectangular cross-sectional configuration, over which the film slides forward on all sides and where it is engaged by a positive transportation means 7 in the form of two horizontal rollers 8 and two vertical rollers 9. From sleeve member 6, the tubular film extends to a diaphragm 10 in the form of two horizontal rollers 11 and two vertical rollers 12. The free passageway of diaphragm 10 is equal to that of a unit a1–a4 to be wrapped with film 3 in contact therewith.

Conveyor 1 extends to just upstream of diaphragm 10, while a further conveyor 13 links up with diaghragm 10 for conveying units a5–a9 wrapped by film 3. In the path defined by conveyor 13, clamping means 14 are provided, which can pinch the film tube between two units, possibly seal it, and separate it, as well as exert a tensile force on the film tube in the direction of transport. For this purpose clamping means 14 are arranged to be displaceable in the direction of transport in a controlled manner.

The wrapping of a unit a is effected as follows.

Unit a1 is supplied in spaced relationship to a preceding unit a2 by means of conveyor 1. Unit a2 is shown in the position in which it is surrounded with clearance by the tubular film 3, or in that position unit a2 enters the film tube. At a further stage, over unit a3, film 3 is connected to a closed tube by means of unit 5. Downstream of connecting unit 5, which often operates with heat as a sealing or fusing unit, cooling means not shown may be provided. Unit a4 moves through sleeve member 6, which has suitable inner dimensions for the purpose. After leaving sleeve member 6, the unit will move from conveyor 1 through diaphragm 10 to the further conveyor 13, whereby a unit, such as unit a5 shown is tautly wrapped by the tubular film 3.

The taut wrapping is the result of film 3 being stretched in the direction of transport by clamping means 14 while the film tube is retained by the positive conveyor 7. The latter passes a certain length of film 3 per time unit. By causing the film tube clamping means 14 to transverse a longer path per unit time, the film tube can be stretched. Such stretching is accompanied by a constriction of the film tube, as a result of which it beds down onto a unit, such as a6. The stretching of film 3 is principally effected where film 3 does not make contact with other parts, such as a unit being wrapped. In this way film 3 will experience the largest amount of stretch between positive transportation means 7 and diaphragm 10 and further between two units, such as units a5 and a6, at which position an additional constriction will be formed. Stretching film 3 mainly in th region first referred to is promoted by the provision of diaphragm 10, which has the minimum required constrictive dimensions.

In order that the film tube is at all times kept under the desired stretching force, at least two clamping units 14 should be provided, at least insofar as there are no other means generating and maintaining a stretching force. In connection with this latter, it would be possible to provide means, for example conveyor belts on opposite sides of conveyor 13 to engage with the top and bottom of the units wrapped with film.

The function of clamping motions 14 is not only to generate a stretching force. In addition, if a hexagonal fully enclosing wrapper is desired, the clamping means 14 may also serve to close the tube in front of and behind a unit being wrapped, such as unit a7, and to connect the thus contacted tube portions in such a manner that the unit is fully enclosed by film 3. For this purpose, for example, clamping means 14 may be provided with sealing or fusing means. Finally, at the position of clamping means 14, the film tube should be separated to separate a fully enveloped unit, such as unit a8, from the next unit, so that a separate unit, such as unit a9, fully enclosed by film 3, is produced, which is discharged via conveyor 13. Separating the film tube can be effected during the connecting step by means of heat, but can also be effected mechanically, for example, by means of a knife or otherwise.

Any desirable and suitable stretch wrapping film can be used for film 3, such as films on the basis of polypropylene, polyethylene, polyvinyl chloride and ethylene vinyl acetate. The preferred material is Linear Low-Density Polyethylene (LLDPE). This last material, for example, makes for film tube constriction of about 30% at a stretch of about 200%, while retaining a sufficient strength of the resulting film wrapper.

It goes without saying that many modifications and variants are possible without departing from the scope of the present invention. As already observed, downstream of diaphragm 10, transport and stretching means in the form of conveyor belts laterally engaging with the units may be provided. Furthermore, it would be possible, rather than making the film tube from one web of film, to supply and interconnect a plurality of webs of film, for example two, with one web being supplied from the top and from web from the bottom, with the webs being interconnected laterally of the units. The embodiment show is an apparatus capable of operating continuously. Naturally, it is also possible to realize the wrapping method according to the present invention with an apparatus operating stepwise. Depending on a unit to be wrapped, the film tube formed may be folded into any other configuration in addition to a rectangular cross-section, for example, circular, oval, triangular, hexagonal, etc.

What is claimed is:

1. In a method of wrapping articles in a plastic film which is applied in tubular form around a unit of articles and thereafter subjected to a stretching and spring-back treatment to cause said film to contract tautly on to the unit being wrapped, the improvement comprising folding and connecting a stretch wrapping film supplied from at least one supply roll into the form of a tube with a cross-section sufficiently large to introduce a unit to be wrapped into such tube and transport it therein without the unit to be wrapped making contact with the tube wall, stretching the tube thus made in its longitudinal direction to such an extent as to cause said tube to constrict and contract tautly on to the unit being wrapped, closing the stretched and constructed tube in front of and behind the unit being wrapped and separating the stretched and constricted tube behind the unit being wrapped whereby the unit being wrapped is enveloped with tautly stretched film.

2. The method of claim 1, wherein the region in which the film is formed and connected into a tube is kept substantially free from tension by causing said region to be kept separate from the region in which the tube is stretched in the longitudinal direction, by positive-transport means.

3. The method of claim 2 wherein the tube is engaged downstream of the positive-transport means by a means which conveys the tube in the downstream direction at a rate greater than that at which the positive-transport means supplies the tube thereby exerting a tensile force on a portion of the tube and consequently longitudinally stretching said portion.

4. The method of claim 3 wherein said engaging means is a means for closing the tube.

5. The method of claim 3 wherein said engaging means is a mechanism for transporting a unit of articles on which a portion of the tube has already been constricted downstream at a rate greater than the output of the positive-transport means.

6. The method of claim 2 or 3 wherein the tube stretching region is concentrated substantially in a region bounded by the positive-transport means and a means defining a passageway attuned to the cross-section of a unit which is being wrapped and which is being tautly enveloped by a portion of the tube.

7. The method of claim 6 wherein a spaced relationship is maintained between the units being supplied to said means attuned to the cross-section of the unit being wrapped.

8. The method of claim 1, 2 or 3 wherein said film comprises Linear Low-Density Polyethylene.

9. The method of claim 1 wherein said film is provided with a tear strip extending in the longitudinal direction of the tube which is formed from it.

10. The method of claim 8 wherein said film is provided with a tear strip extending in the longitudinal direction of the tube which is formed from it.

11. The method of claims 1, 2 or 3 wherein the closed ends of said tube are sealed.

12. In an apparatus for wrapping articles in a plastic film comprising at least one holder for a roll of film webbing, means for applying a film wrapper, in tubular form, around a unit of articles being wrapped, means for causing said film, by a stretching and spring-back treatment to contract tautly on to the unit being wrapped and means for separating the tubular film wrapper, means for supplying a unit to be wrapped and means for discharging a wrapped unit, the improvement wherein the means for applying a film wrapper around a unit of articles to be wrapped comprise a folding and guiding unit which brings the film into tubular form and elements connecting the film to produce a closed tubular form, the means for causing the film to contract tautly on to the unit being wrapped comprises a sleeve member, a positive-transport means placed alongside and cooperating with the outer circumference of said sleeve member and drawing means positioned downstream of said positive-transport means and movable in the direction of film transport at a velocity higher than the output velocity of the positive-transport means, the means for separating a wrapped unit comprise a clamping mechanism and a separating mechanism, and the means for supplying and the means for discharging are separate means with a separating boundary downstream from the sleeve member of the contracting means.

13. The apparatus of claim 12, wherein the drawing means comprise the clamping mechanism.

14. The apparatus of claim 12, wherein the drawing means comprise conveyor belts disposed along two opposite sides of the path of transport downstream of said positive transport means.

15. The apparatus of claim 12, 13 or 14, wherein diaphragm means are disposed intermediate said positive-transport means and said drawing means, said diaphragm means defining a free passageway smaller than that of the sleeve member.

16. The apparatus of claim 15, wherein said diaphragm means comprise a set of four rollers, positioned two by two in parallel relationship and together defining a rectangular passageway.

17. The apparatus of claim 12, 13 or 14, wherein the positive-transport means comprise at least one set of four rollers positioned two by two in parallel relationship and together forming a rectangular passageway attuned to the outer circumference of the sleeve member, which is also rectangular in cross-section.

18. The apparatus of claim 17 wherein the rollers comprising said positive-transport means are made of a resilient material and the sleeve member is made of a rigid material.

19. The apparatus of claim 18 wherein the resilient roller material is rubber and the rigid sleeve material is steel.

20. The apparatus of claim 15, wherein the diaphragm means is located at the boundary between the supplying means and the discharging means.

21. The apparatus of claim 20, wherein the supplying and discharging means are both conveyors which terminate and initiate, respectively, at the diaphragm means.

* * * * *